US009319773B2

(12) United States Patent
Blonder

(10) Patent No.: US 9,319,773 B2
(45) Date of Patent: Apr. 19, 2016

(54) AUDIO BASS RESONATOR

(71) Applicant: IdeaVillage Products Corp., Wayne, NJ (US)

(72) Inventor: Greg E. Blonder, Summit, NJ (US)

(73) Assignee: IdeaVillage Products Corporation, Wayne, NJ (US)

( * ) Notice: Subject to any disclaimer, the term of this patent is extended or adjusted under 35 U.S.C. 154(b) by 0 days.

(21) Appl. No.: 14/463,119

(22) Filed: Aug. 19, 2014

(65) Prior Publication Data

US 2015/0055812 A1 Feb. 26, 2015

Related U.S. Application Data

(60) Provisional application No. 61/867,870, filed on Aug. 20, 2013.

(51) Int. Cl.

| | |
|---|---|
| ***H04R 1/20*** | (2006.01) |
| ***H04R 1/28*** | (2006.01) |
| ***H04R 1/10*** | (2006.01) |
| *H04R 25/00* | (2006.01) |

(52) U.S. Cl.

CPC ..... *H04R 1/2834* (2013.01); *H04R 1/10* (2013.01)

(58) Field of Classification Search

CPC .... H04R 5/033; H04R 1/1058; H04R 1/1075; H04R 1/1008; H04R 1/104; H04R 2400/03; H04R 3/00; H04R 1/1016; H04R 1/105; H04S 3/00; H04S 2400/07; A61M 2021/0022; A61M 2021/0027

USPC ..... 381/186, 335, 74, 309, 380, 151, 339, 381/371, 372, 374, 77

See application file for complete search history.

(56) References Cited

U.S. PATENT DOCUMENTS

| | | | | |
|---|---|---|---|---|
| 8,077,898 | B2 * | 12/2011 | Huang | 381/345 |
| 8,085,966 | B2 * | 12/2011 | Amsel | 381/370 |
| 2005/0147272 | A1 * | 7/2005 | Hyre et al. | 381/398 |
| 2014/0334656 | A1 * | 11/2014 | Lu | 381/370 |

* cited by examiner

*Primary Examiner* — Paul S Kim
*Assistant Examiner* — Norman Yu
(74) *Attorney, Agent, or Firm* — Dan De La Rosa

(57) ABSTRACT

A headphone comprising: at least one speaker housing comprising at least a first surface with a first opening and a second surface with second opening; at least one resonator designed to cover at least a portion of the second opening of the second surface; at least one speaker, at least a portion of the speaker disposed within the speaker housing proximate to the first opening of the first surface of the speaker housing.

23 Claims, 4 Drawing Sheets

AUDIO BASS RESONATOR

CROSS-REFERENCE TO RELATED APPLICATIONS

This application is related to, and claims priority to, U.S. Provisional Application Ser. No. 61/867,870 filed on Aug. 20, 2013 entitled "Audio Bass Resonator", the disclosure of which is hereby incorporated by reference in its entirety.

TECHNICAL FIELD

Embodiments of the present disclosure relate to the field of audio devices and, more particularly, to a headphone including an air-driven resonator for additional bass production.

BACKGROUND

There are various patents covering headphones and headsets. The present invention provides for a headphone that can be used as a music listening device with increased base response.

Conventional wearable audio producing devices, such as headphones were designed to be powered directly from the output of an audio source, such as a stereo system, MP3 player or smartphone. These audio sources are typically limited to less than 100 mW of power, and a 1 Volt signal amplitude.

In many applications it is desirable to produce an additional or enhanced bass response from headphones. In some additional applications it may be desirable to produce an enhanced bass response from headphones when the internal speakers have been activated. In some additional applications it may be desirable to produce an enhanced bass response from headphones when the internal speakers have been activated such as when sharing audio with one or more additional listeners or when wearing the headphones around the neck. There may also be a need to produce the additional bass without having to add the expense and effort of including additional circuitry or drivers specifically configured to produce bass frequencies.

SUMMARY OF INVENTION

In one embodiment, the present invention provides a headphone comprising at least one speaker housing comprising at least a first surface with a first opening and a second surface with second opening; at least one resonator designed to cover at least a portion of the second opening of the second surface; at least one speaker, at least a portion of the speaker is disposed within the speaker housing proximate to the first opening of the first surface of the speaker housing.

In yet another embodiment, the headphone has a speaker comprises a moving portion, and the speaker housing encloses a volume of air. The moving portion is coupled to the volume of air such that the volume of air moves in response to motion of the moving portion of the speaker.

In a further embodiment, the resonator has a shape which is selected from a group comprising a donut, square, oval, round, cylindrical, circular and rectangular.

In still another embodiment, the speaker creates pressure within the speaker housing, thereby causing at least a portion of the resonator to move.

In yet a further embodiment, the resonator includes a resilient element having a spring constant, and a mass element having a mass, and wherein altering the mass and the spring constant alters the movement of the resonator.

In still a further embodiment, the resilient element is constructed of a material selected from a group comprising paper, rubber, foam, plastic, metal, synthetics and silicone.

In another embodiment, the resilient element is a spring. In a further embodiment, the resilient element is a gasket.

In yet another embodiment, the first surface is configured to be placed proximal to a user's ear. In still a further embodiment, the first surface is configured to contact a user's ear.

In still another embodiment, a headphone of the present invention further comprises: a second speaker housing; a second resonator; and a second speaker.

In yet a further embodiment, the headphone further comprises an amplifier.

In still another embodiment, the present invention relates to a headphone comprising: at least one speaker housing comprising at least a first surface with a first opening and a second surface with second opening; at least one resonator designed to cover at least a portion of the second opening of the second surface; at least one speaker, at least a portion of the speaker is disposed within the speaker housing proximate to the first opening of the first surface of the speaker housing, the speaker comprises a moving portion, and the speaker housing encloses a volume of air, and wherein the moving portion is coupled to the volume of air such that the volume of air moves in response to motion of the moving portion of the speaker, thereby causing motion in at least some portion of the resonator.

In yet another embodiment, the motion of the moving portion of a speaker creates an enhanced bass output from the headphone.

In still another embodiment, the resonator shape is selected from a group comprising: a donut, square, oval, round, cylindrical, circular and rectangular.

In another embodiment, the resonator includes a mass element constructed of a material selected from a group comprising metal, powder, glass, water, gels, and pads.

In yet another embodiment, the resonator includes a resilient element constructed of a material selected from a group comprising of paper, rubber, foam, plastic, metal, synthetics and silicone.

In another embodiment, the present invention relates to a headphone comprising: at least two speaker housings, each of the speaker housings comprising at least a first surface with a first opening and a second surface with second opening; at least two resonators, each of the resonators designed to cover at least a portion of each of the second openings; at two speakers, at least a portion of each of the speakers is disposed within each of the speaker housings proximate to each of the first openings.

In still another embodiment, the first and second speaker housings are joined via a headband.

In still a further embodiment, at least one of the speaker housings encloses at least a portion of an amplifier.

BRIEF DESCRIPTION OF THE DRAWINGS

The accompanying drawings are included to provide a further understanding of the present invention. These drawings are incorporated in and constitute a part of this specification, illustrate one or more embodiments of the present invention and together with the description, serve to explain the principles of the present invention.

Among those benefits and improvements that have been disclosed, other objects and advantages of this invention will become apparent from the following description taken in conjunction with the accompanying drawings. The drawings constitute a part of this specification and include exemplary embodiments of the present invention and illustrate various objects and features thereof.

DETAILED DESCRIPTION OF THE INVENTION

A headphone (alternatively referred to as a "headset") that includes a bass resonator is described herein. In another embodiment, a headphone that may include an amplifier and bass resonator is described herein. In an embodiment, the bass resonator employs a passively driven mass built into each speaker housing of the headphone. In another embodiment the resonator is a discrete assembly attached to the speaker housing.

The headphone includes a housing which encloses a volume of air. Advantageously, the speaker of the headphone produces sufficient airflow (and corresponding pressure) within the speaker chamber to passively drive the bass resonator. The passive driving of the bass resonator uses varying pressure created by movement of the speaker to set this mass into motion, thereby enabling the bass resonator to vibrate in synchrony with the audio, and in particular low frequency audio, components produced by the source (e.g., the music, speech, etc.). In addition the vibration of the bass resonator causes the housing to vibrate providing a tactile sensation of bass when the headphone is in contact with a user (e.g., worn on the head or worn around the user's neck) or in physical proximity to the user. In another embodiment, the bass resonator includes a resilient element (e.g., a spring or other suitable movable component) in communication with a mass configured to vibrate at a particular frequency (or within a frequency range) when driven by the air within the speaker chamber. In yet another embodiment the resilient element is made integral to the speaker housing.

Figure 1:
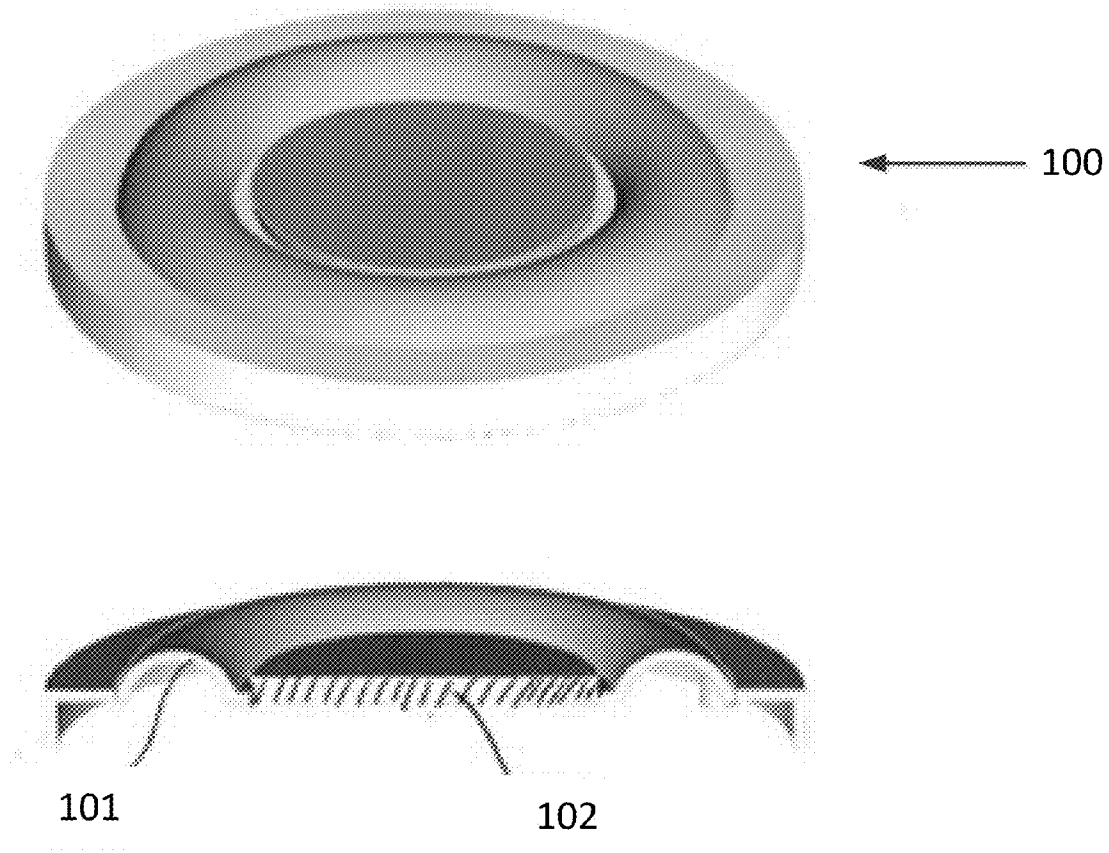
FIG. 1 is a perspective and cross-sectional view of the bass resonator of the present invention.

FIG. 1 illustrates a bass resonator 100 including a mass element 102 in communication with a resilient element 101, according to one embodiment of the present invention. The bass resonator 100 may be any suitable shape, such as for example, an oval or square. In a further embodiment, the bass resonator 100 is a circular shape, as shown in FIG. 1.

The mass element 102, for example a metal disk, is operatively coupled to the resilient element 101. The resilient element 101 is a flexible material constructed from any suitable material such as paper, foam, metal, rubber, synthetics, silicone or plastic. The resilient element 101 acts as a spring with a corresponding spring constant. The combination of the spring constant of the resilient element 101 and the mass of the mass element 102 defines the natural frequency of oscillation of the resonator 100. Either of the spring constant or the mass may be modified to alter the natural frequency of oscillation of the resonator 100. In yet another embodiment, the combination of spring constant and mass may be selected so that resonator 100 oscillates at a natural frequency of between 50 Hz and 150 Hz. The mass element 102 may be made from any suitable material such as metal, powder, glass, water, gels, and pads.

Figure 2:
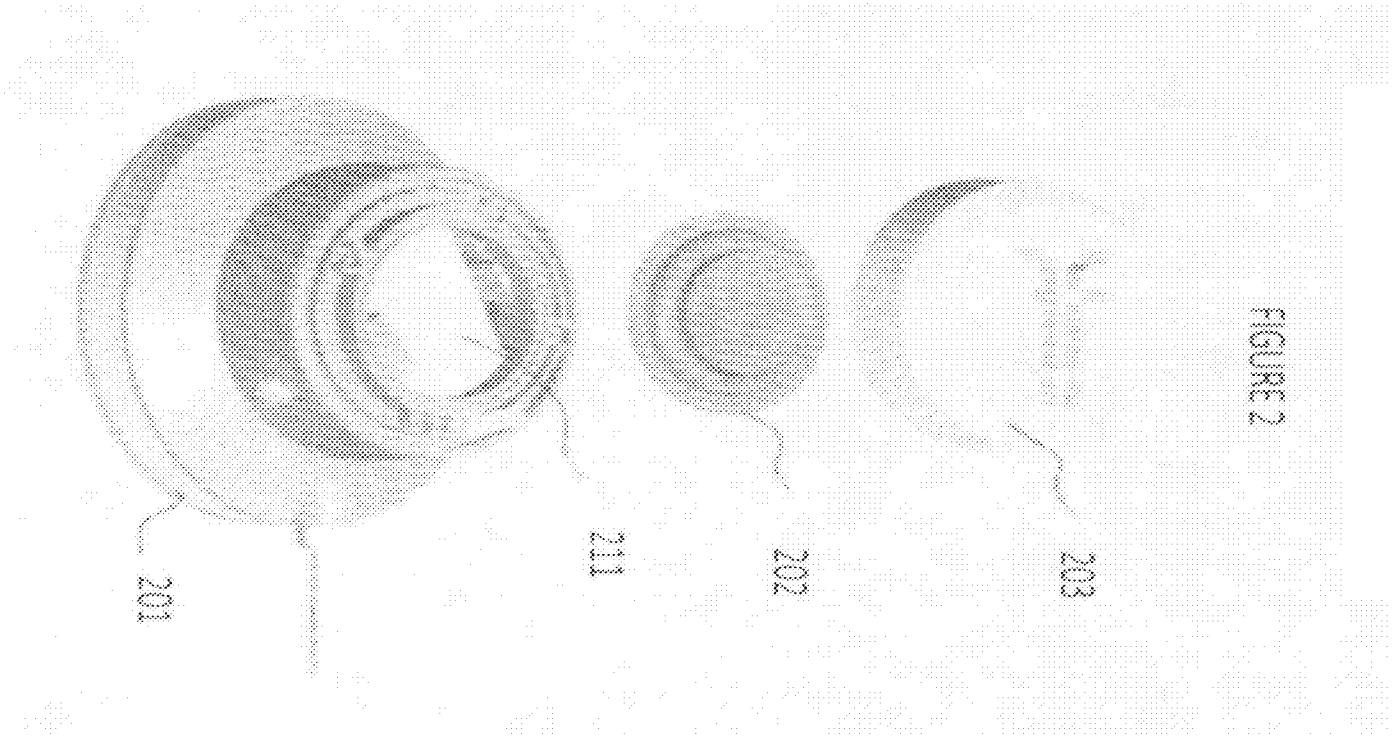
FIG. 2 is an exploded view of an embodiment of the present invention.

FIG. 2 illustrates one embodiment of a headphone speaker housing incorporating a main housing 201, a resonator 202, and a resonator cover 203. The embodiment may include a speaker, an amplifier, electronics, etc (not shown). In the embodiment, the main housing 201 includes an opening 211 over which the bass resonator 202 is mounted. In an embodiment, the bass resonator is mounted in such a manner that air cannot leak between the resonator 202 and the housing 201. Any suitable securing material or technique may be used to secure the bass resonator 202 in place over the opening 211, such as, for example and without limitation, screws, glue, ultra sonic welding, etc. In yet a further embodiment, the resilient element 101, shown in FIG. 1, maybe co-molded, overmolded, or otherwise made an integral part of housing 201. In operation, the speaker (not shown) produces vibrations (and corresponding air pressure) which drives the bass resonator 202.

In another embodiment, a resonator cover 203 is attached over the resonator 202. In yet another embodiment the attachment of the resonator cover 203 to housing 201 is used to simultaneously secure the bass resonator 202 to the housing 201 in such a manner where that the resonator 202 forms a gasket between housing 201 and cover 203.

Figure 3:
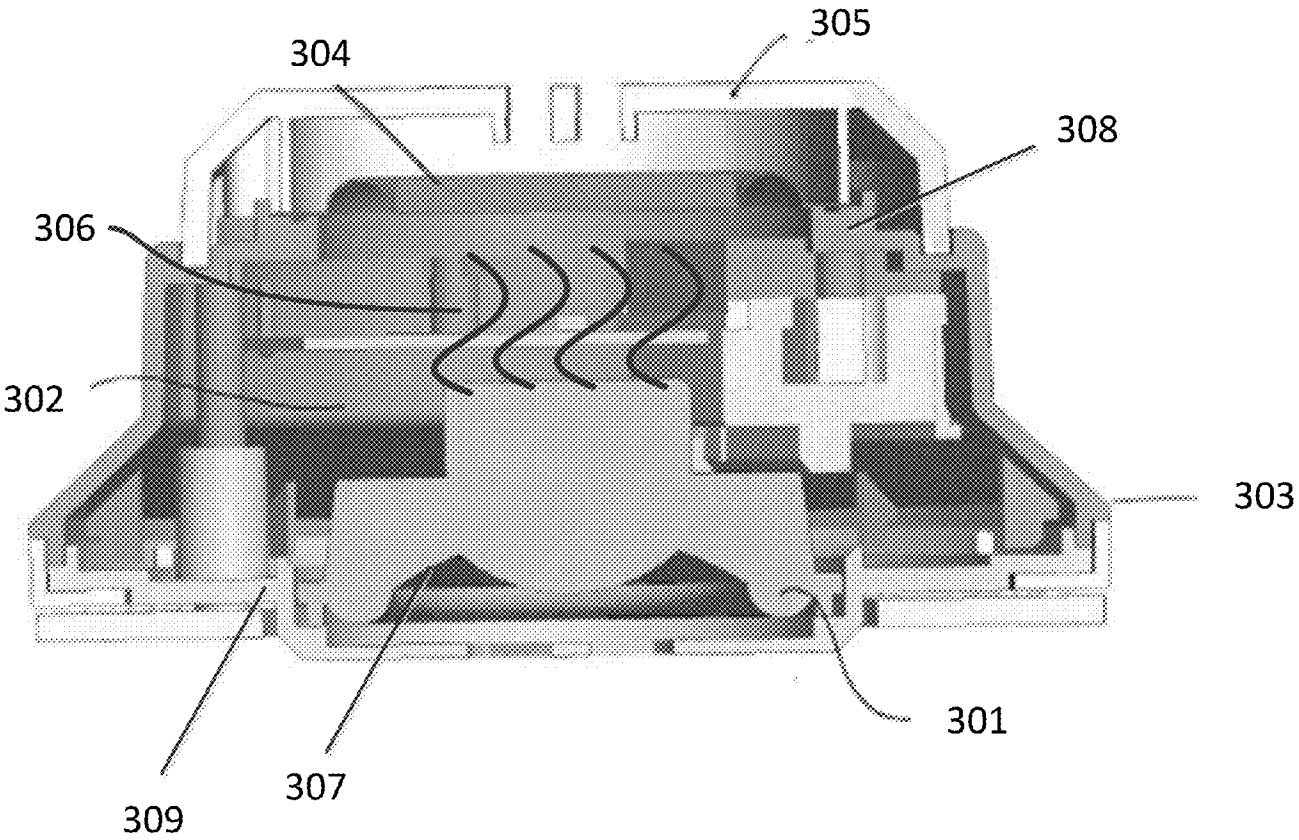
FIG. 3 is cross-sectional view of an embodiment of the present invention.
Figure 4:
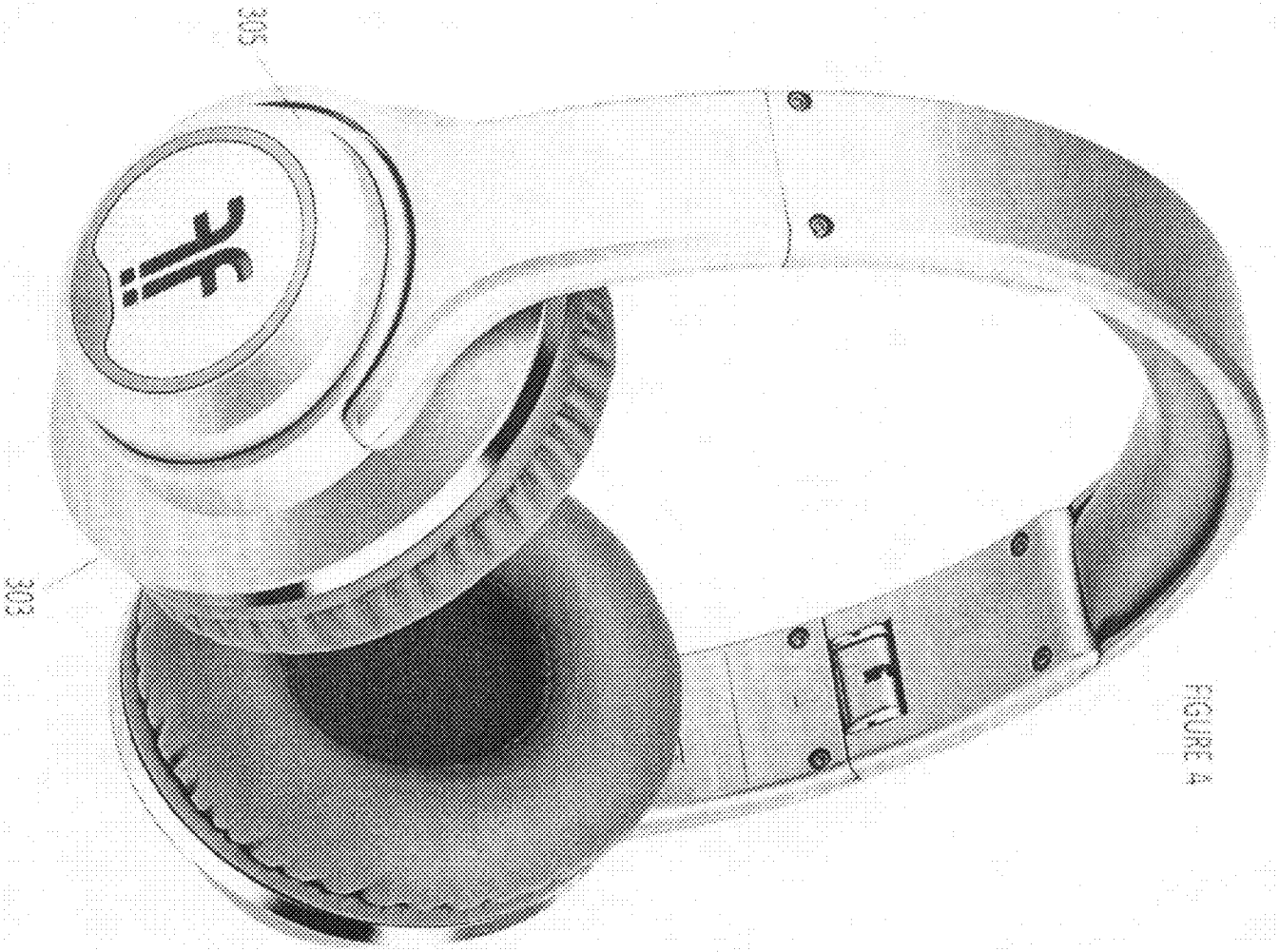
FIG. 4 is a perspective view of the present invention with two speaker housings.

FIG. 3 illustrates a cross-sectional view of a portion of headphone assembly including a speaker 301 with speaker cone 307, bass resonator 304, cavity 302, resonator cover 305, within a housing 303. Housing 303 includes a first surface 309 and a second surface 308. When speaker 301 is operating, the movement of speaker cone 307 creates vibrations that change the corresponding pressure of the volume of air contained in the cavity 302. These air pressure changes (illustrated in FIG. 3 by the wavy lines 306) drive the bass resonator 304 to move. The volume of air coupled to the speaker cone 307 is most effective at driving the bass resonator 304 at the bass resonator's natural frequency. The driving of the bass resonator 304 causes the resonator 304 to create additional sound waves in the air outside of the speaker housing 303 which enhances the bass from speaker 301. In another embodiment, the first surface 309 is configured with a hole for the speaker 301 and an additional hole for the bass resonator 304, such that both elements are mounted on the same portion of housing 303. In an embodiment, resonator cover 305 is integral to housing 303 and resonator 304 is mounted inside housing 303.

In an embodiment, the housing 303 may include a mechanical or electrically operated mechanism (not shown) that restrains the resonator 304 from moving. For example, a movement inhibitor may be employed to prevent the headset from vibrating off a smooth table, or when added bass is detrimental to the musicality of the source content.

As used herein, the terms "example", and/or "exemplary" are utilized to mean serving as an example, instance, or illustration. For the avoidance of doubt, the subject matter disclosed herein is not limited by such examples. In addition, any aspect or design described herein as an "example" and/or "exemplary" is not necessarily to be construed as preferred or advantageous over other aspects or designs, nor is limited to preclude equivalent exemplary structures and techniques known to those of ordinary skill in the art.

Numerous modifications and variations of the present invention are possible in light of the above teachings. It is therefore to be understood that within the scope of the attendant claims attached hereto, this invention may be practiced otherwise than as specifically disclosed herein.

What is claimed is:

1. A headphone, comprising:

at least one speaker housing comprising at least a first surface with a first opening and a second surface with second opening;

at least one resonator designed to cover at least a portion of said second opening of said second surface; and at least one speaker, at least a portion of said speaker is disposed within said speaker housing proximate to said first opening of said first surface of said speaker housing, said resonator causes said speaker housing to vibrate thereby creating a tactile sensation for a user in contact with said headphone.

2. The headphone of claim 1, wherein said speaker comprises a moving portion, and wherein said speaker housing encloses a volume of air, and wherein said moving portion is coupled to the volume of air such that the volume of air moves in response to motion of said moving portion of said speaker.

3. The headphone of claim 1, wherein said resonator has a shape, said shape is selected from a group comprising a donut, square, oval, round, cylindrical, circular and rectangular.

4. The headphone of claim 1, wherein said speaker creates pressure within said speaker housing, thereby causing at least a portion of said resonator to move.

5. The headphone of claim 4, wherein said resonator includes a resilient element having a spring constant, and a mass element having a mass, and wherein altering said mass or said spring constant alters said movement of said resonator.

6. The headphone of claim 5, wherein said resilient element is constructed of a material selected from a group comprising: paper, rubber, foam, plastic, metal, synthetics and silicone.

7. The headphone of claim 5, wherein said resilient element is a spring.

8. The headphone of claim 5, wherein said resilient element is a gasket.

9. The headphone of claim 1, wherein said first surface is configured to be placed proximal to a user's ear.

10. The headphone of claim 1, wherein said first surface is configured to contact a user's ear.

11. The headphone of claim 1, further comprising a second speaker housing; a second resonator; and a second speaker.

12. The headphone of claim 1, further comprising an amplifier.

13. A headphone comprising:

at least one speaker housing comprising at least a first surface with a first opening and a second surface with second opening;

at least one resonator configured to cover at least a portion of said second opening of said second surface; and at least one speaker, at least a portion of said speaker is disposed within said speaker housing proximate to said first opening of said first surface of said speaker housing, said speaker comprises a moving portion, and said speaker housing encloses a volume of air, and wherein said moving portion is coupled to the volume of air such that the volume of air moves in response to motion of said moving portion of said speaker, thereby causing motion in at least some portion of said resonator, said resonator causes said speaker housing to vibrate thereby creating a tactile sensation for a user in contact with said headphone.

14. The headphone of claim 13, wherein said motion creates an enhanced bass output of said headphone.

15. The headphone of claim 13, wherein said resonator has a shape, said shape is selected from a group comprising a donut, square, oval, round, cylindrical, circular and rectangular.

16. The headphone of claim 13, wherein said resonator includes a mass element constructed of a material selected from a group comprising powder, glass, water, gels, and pads.

17. The headphone of claim 13, wherein said resonator includes a resilient element constructed of a material selected from a group comprising of paper, rubber, foam, plastic, metal, synthetics and silicone.

18. The headphone of claim 17, wherein said resilient element is a spring.

19. The headphone of claim 17, wherein said resilient element is a gasket.

20. The headphone of claim 13, further comprising a second speaker housing; a second resonator; and a second speaker.

21. A headphone comprising:

at least two speaker housings, each of said speaker housings comprising at least a first surface with a first opening and a second surface with second opening;

at least two resonators, each of said resonators designed to cover at least a portion of each of said second openings; and at least two speakers, at least a portion of each of said speakers is disposed within each of said speaker housings proximate to each of said first openings, said resonator causes said speaker housing to vibrate thereby creating a tactile sensation for a user in contact with said headphone.

22. The headphone of claim 21, wherein said first and second speaker housings are joined via a headband.

23. The headphone of claim 21, wherein at least one of said speaker housings encloses at least a portion of an amplifier.

* * * * *